US011355867B2

(12) United States Patent
Oshima

(10) Patent No.: US 11,355,867 B2
(45) Date of Patent: Jun. 7, 2022

(54) POLARIZED WAVE SHARED ARRAY ANTENNA AND METHOD FOR MANUFACTURING THE SAME

(71) Applicant: NEC Corporation, Tokyo (JP)

(72) Inventor: Naoki Oshima, Tokyo (JP)

(73) Assignee: NEC CORPORATION, Tokyo (JP)

( * ) Notice: Subject to any disclaimer, the term of this patent is extended or adjusted under 35 U.S.C. 154(b) by 0 days.

(21) Appl. No.: 16/910,761

(22) Filed: Jun. 24, 2020

(65) Prior Publication Data

US 2020/0412025 A1 Dec. 31, 2020

(30) Foreign Application Priority Data

Jun. 26, 2019 (JP) ..... JP2019-118707

(51) Int. Cl.

| | |
|---|---|
| ***H01Q 25/00*** | (2006.01) |
| ***H01Q 21/24*** | (2006.01) |
| ***H01Q 21/06*** | (2006.01) |
| ***H01Q 21/10*** | (2006.01) |
| ***H01Q 5/35*** | (2015.01) |
| ***H01Q 25/04*** | (2006.01) |

(52) U.S. Cl.

CPC ..... *H01Q 25/001* (2013.01); *H01Q 5/35* (2015.01); *H01Q 21/065* (2013.01); *H01Q 21/10* (2013.01); *H01Q 21/24* (2013.01); *H01Q 25/04* (2013.01)

(58) Field of Classification Search

CPC ..... H01Q 25/001; H01Q 21/10; H01Q 5/35; H01Q 25/04; H01Q 21/065; H01Q 21/24; H01Q 5/50; H01Q 9/0428; H01Q 9/045

USPC ..... 343/850

See application file for complete search history.

(56) References Cited

U.S. PATENT DOCUMENTS

| | | | | |
|---|---|---|---|---|
| 5,287,116 A * | 2/1994 | Iwasaki | ..... | H01Q 9/0442 343/700 MS |
| 6,175,333 B1 * | 1/2001 | Smith | ..... | H01Q 1/38 343/700 MS |
| 2019/0221947 A1 * | 7/2019 | Zihir | ..... | H01Q 21/245 |

FOREIGN PATENT DOCUMENTS

| | | |
|---|---|---|
| JP | 2019-047238 A | 3/2019 |

* cited by examiner

*Primary Examiner* — Andrea Lindgren Baltzell
*Assistant Examiner* — Yonchan J Kim

(57) ABSTRACT

A polarized wave shared array antenna according to an example embodiment includes: antenna elements 11*a* and 11*b* provided adjacent to each other on one surface of an antenna substrate 1, each of which being configured to generate two orthogonal linear polarized waves; feeding points 12*a* and 12*b* disposed in a first direction when viewed from each antenna element and feeding points 14*a* and 14*b* disposed in a second direction orthogonal to the first direction when viewed from each antenna element; transmission and reception units 21*a*, 21*b*, 22*a*, and 22*b* that are provided on an integrated circuit on the other surface of the antenna substrate 1 and are respectively connected to the feeding points, in which in a plan view, the feeding points are disposed so as to be arranged on a straight line, and wirings connecting the transmission and transmission units to the corresponding feeding points are equal in length.

10 Claims, 9 Drawing Sheets

POLARIZED WAVE SHARED ARRAY ANTENNA AND METHOD FOR MANUFACTURING THE SAME

INCORPORATION BY REFERENCE

This application is based upon and claims the benefit of priority from Japanese patent application No. 2019-118707, filed on Jun. 26, 2019, the disclosure of which is incorporated herein in its entirety by reference.

TECHNICAL FIELD

The present disclosure relates to a polarized wave shared array antenna and a method for manufacturing the same.

BACKGROUND ART

The rapid spread of radio communication has led to a problem that there is a shortage in frequency bands used for radio communication. One of techniques for effectively using a frequency band is beamforming. Beamforming is a technique in which interference with other radio systems is prevented while signal quality is maintained by radiating radio waves having directivity, thereby enabling radio communication with a predetermined communication target.

A typical technique for achieving beamforming is phased array. Phased array is a technique for enhancing a signal in a desired direction by adjusting the phases of radio signals fed to a plurality of antenna elements in a transmitter and combining radio waves radiated from each antenna element in space.

In recent years, an integral-type module in which a planar antenna such as a patch antenna and a high-frequency unit of a transceiver are mounted on each of both sides of a substrate has been receiving attention in terms of reducing the size of an antenna module. It is desired that a plurality of antenna elements in the phased array be disposed at intervals of about a half wavelength of a carrier wave. Therefore, as the frequency becomes higher, the intervals between the antennas become shorter. Consequently, the size of the above-described integral-type module becomes small.

Giving a millimeter-wave band as an example, the half wavelength is 5 mm at 30 GHz (a wavelength of 10 mm), and the half wavelength is 2.5 mm at 60 GHz band (a wavelength of 5 mm). It is necessary to mount a transmission and reception unit in these about half-wavelength regions in order to implement an integral-type module, and accordingly it becomes essential to integrate a plurality of transceivers including a phase shifter.

Further, in the phased array, if the characteristics of the individual arrays deviate from the assumed weighting of phases, the beam deviates from the desired direction. Therefore, it is desired that the wiring layouts of all arrays from the transmission and reception unit to the feeding point of an antenna have the same shape.

Japanese Unexamined Patent Application Publication No. 2019-047238 discloses two four-element arrays, each of which is composed of four radiating elements. One of these arrays is formed on each of the two sub-arrays, and power is supplied by running feed lines between the four element arrays and wiring one of the feed lines to each radiating element, the wirings being equal in length to each other. In Japanese Unexamined Patent Application Publication No. 2019-047238, in order to reduce the number of side lobes, feeding points to the two sub-arrays are provided at both ends of a printed circuit board and the directions in which power is supplied to the two sub-arrays are made opposite to each other.

Polarization diversity and polarization multiple-input and multiple-output (MIMO) that use two types of orthogonal polarized waves may be used in order to improve communication quality. When two types of polarized waves are generated simultaneously by one antenna element, two transmission and reception units integrated in an integrated circuit are respectively connected to two feeding points disposed at positions different from each other in the one antenna element.

When power is supplied to a plurality of polarized wave shared planar antennas, it is required that all wirings to respective feed points be made equal in length in order to make the characteristics of two polarized waves of respective antenna elements equal. However, in order to make all wirings from respective transmission and reception units to the corresponding feeding points equal in length, wirings of complicated shapes are required, which causes a problem that wiring loss increases and a man-hour for designing increases.

SUMMARY

The present disclosure has been made in view of the above-described problem and an object thereof is to provide a polarized wave shared array antenna in which wirings from a plurality of transmission and reception units integrated in an integrated circuit to respective feeding points of polarized wave shared antenna elements are equal in length without making the shapes of the wirings complicated, and a method for manufacturing the same.

A polarized wave shared array antenna according to an aspect of the present disclosure includes: a first antenna element and a second antenna element provided adjacent to each other on one surface of an antenna substrate, each of the first and the second antenna elements being configured to generate two orthogonal linear polarized waves; a first feeding point disposed in the first antenna element in a first direction when viewed from a center of the first antenna element, and a second feeding point disposed in the first antenna element in a second direction orthogonal to the first direction when viewed from the center of the first antenna element; a third feeding point disposed in the second antenna element in the first direction when viewed from a center of the second antenna element, and a fourth feeding point disposed in the second antenna element in the second direction when viewed from the center of the second antenna element; an integrated circuit provided on the other surface of the antenna substrate; a first transmission and reception unit to a fourth transmission and reception unit that are provided on the integrated circuit and are respectively connected to the first to the fourth feeding points; and a first wiring to a fourth wiring that connect the first to the fourth feeding points to the first to the fourth transmission and reception units, respectively, in which in a plan view, the first to the fourth feeding points are disposed so as to be arranged on a first straight line, and the first to the fourth wirings are equal in length.

A method for manufacturing a polarized wave shared array antenna according to an aspect of the present disclosure, the method including: providing a first antenna element and a second antenna element so as to be adjacent to each other on one surface of an antenna substrate, each of the first and the second antenna elements being configured to generate two orthogonal linear polarized waves; disposing a first feeding point in the first antenna element in a first direction when viewed from a center of the first antenna element and a second feeding point in the first antenna element in a second direction orthogonal to the first direction when viewed from the center of the first antenna element; disposing a third feeding point in the second antenna element in the first direction when viewed from a center of the second antenna element and a fourth feeding point in the second antenna element in the second direction orthogonal to the first direction when viewed from the center of the second antenna element; providing an integrated circuit on the other surface of the antenna substrate; providing a first transmission and reception unit to a fourth transmission and reception unit on the integrated circuit, the first to the fourth transmission and reception units, respectively, being connected to the first to the fourth feeding points; disposing the first to the fourth feeding points so as to be arranged on a first straight line in a plan view; and forming a first wiring to a fourth wiring that connect the first to the fourth feeding points to the first to the fourth transmission and reception units, respectively, the first to the fourth wirings being equal in length.

According to the present disclosure, it is possible to provide a polarized wave shared array antenna in which wirings from a plurality of transmission and reception units integrated in an integrated circuit to respective feeding points of polarized wave shared antenna elements are equal in length without making the shapes of the wirings complicated, and a method for manufacturing the same.

BRIEF DESCRIPTION OF DRAWINGS

The above and other aspects, features and advantages of the present disclosure will become more apparent from the following description of certain example embodiments when taken in conjunction with the accompanying drawings, in which.

EXAMPLE EMBODIMENTS

Hereinafter, with reference to the drawings, example embodiments of the present disclosure will be described. For the clarification of the description, the following description and drawings are omitted or simplified as appropriate.

Figure 5:
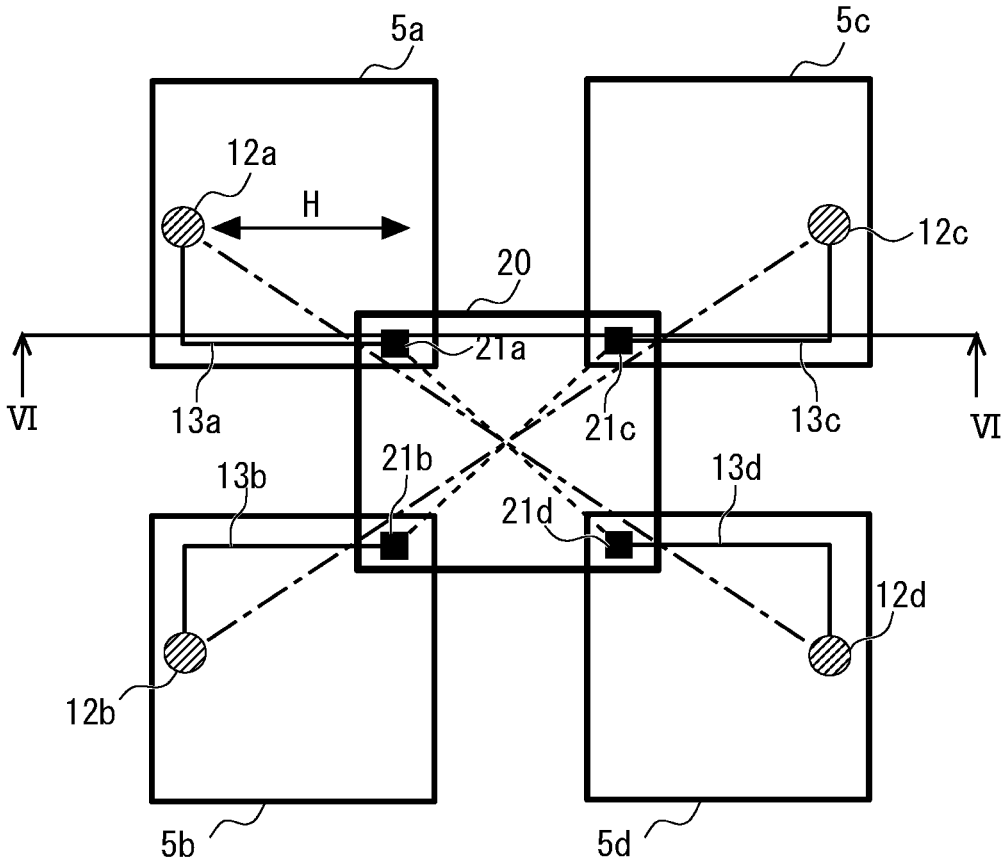
FIG. 5 is a diagram showing a configuration of an antenna according to a comparative example.
Figure 6:
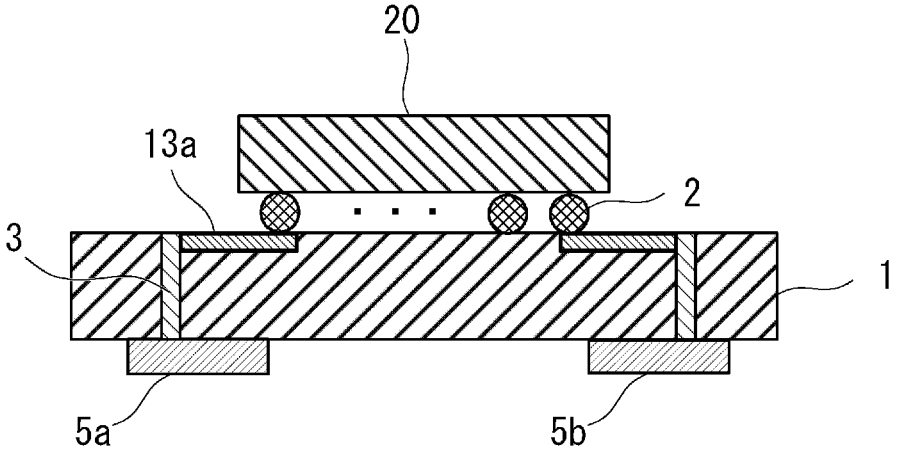
FIG. 6 is a cross-sectional view taken along the line VI-VI of FIG. 5.

Example embodiments relate to a polarized wave shared planar array antenna that generates two orthogonal linear polarized waves. Prior to describing the example embodiments, a problem of a comparative example is described. FIG. 5 is a diagram showing a configuration of an antenna according to the comparative example in which four antenna elements 5*a* to 5*d* are disposed in a 2×2 array. FIG. 6 is a cross-sectional view taken along the line VI-VI of FIG. 5.

As shown in FIG. 6, the antenna elements 5*a* to 5*d* are provided on one surface of an antenna substrate 1 made of a dielectric. Each of the antenna elements 5*a* to 5*d* is a square patch antenna. Each of the antenna elements 5*a* to 5*d*, of which feeding points 12*a* to 12*d* are located so as to be shifted from the center position in the horizontal axis direction in the figure, radiates a polarized wave (an H polarized wave) parallel to the horizontal direction in the figure as shown by a double-headed arrow in FIG. 5.

Further, an integrated circuit 20 is mounted on the other surface of the antenna substrate 1. The integrated circuit 20 includes four transmission and reception units integrated therein, the PADs of transmission and reception units (hereinafter simply referred to as transmission and reception units 21*a* to 21*d*), respectively, are connected to wirings 13*a* to 13*d* via solder 2. Vias 3 are formed in the antenna substrate 1, and the wirings 13*a* to 13*d* are connected to the feeding points 12*a* to 12*d* of the antenna elements 5*a* to 5*d* via the vias 3, respectively.

In FIG. 5, the integrated circuit 20 is disposed so that the center point of the four transmission and reception units 21*a* to 21*d* (the point at which a short-dashed line connecting the transmission and reception unit 21*a* to the transmission and reception unit 21*d* intersects a short-dashed line connecting the transmission and reception units 21*b* to the transmission and reception unit 21*c*) and the center position of the feeding points 12*a* to 12*d* (the point at which an alternate long and short dashed line connecting the feeding point 12*a* to the feeding point 12*d* intersects an alternate long and short dashed line connecting the feeding point 12*b* to the feeding point 12*c*) overlap each other. This configuration makes it possible to form the wirings 13*a* to 13*d* connecting the transmission and reception units 21*a* to 21*d* to the feeding points 12*a* to 12*d*, respectively, so that they are equal in length and in the same shape.

Between the antennas (the antenna elements 5*a* and 5*c* and the antenna elements 5*b* and 5*d*) adjacent to each other in the polarized wave direction, the positions of the feeding points are shifted in directions opposite to each other. However, the positions can be corrected by shifting the phase by 180° with a phase shifter included in each of the transmission and reception units of the integrated circuit 20. By doing so, it is possible to maintain the design symmetry excluding variations in the manufacturing and the mounting, thereby improving the accuracy of beamforming.

Figure 7:
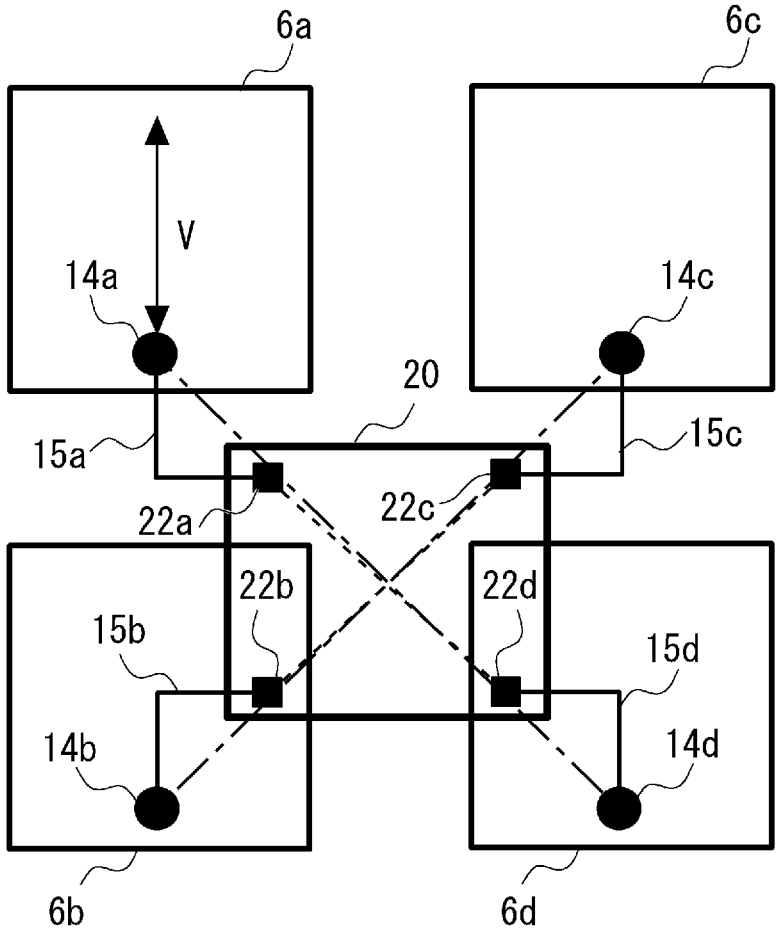
FIG. 7 is a diagram showing the configuration of the antenna according to the comparative example.

Regarding four antenna elements 6*a* to 6*d*, each of which radiates a polarized wave (a V polarized wave) parallel to the vertical direction in the figure as shown by a double-headed arrow in FIG. 7, by disposing the integrated circuit 20 so that the center point of four transmission and reception units 22*a* to 22*d* and the center position of feeding points 14*a* to 14*d* overlap each other as in the case of the antenna of the comparative example arranged in a 2×2 array, it is possible to form wirings 15*a* to 15*d* connecting the transmission and reception units 22*a* to 22*d* to the feeding points 14*a* to 14*d*, respectively, so that they are equal in length and in the same shape.

Figure 8:
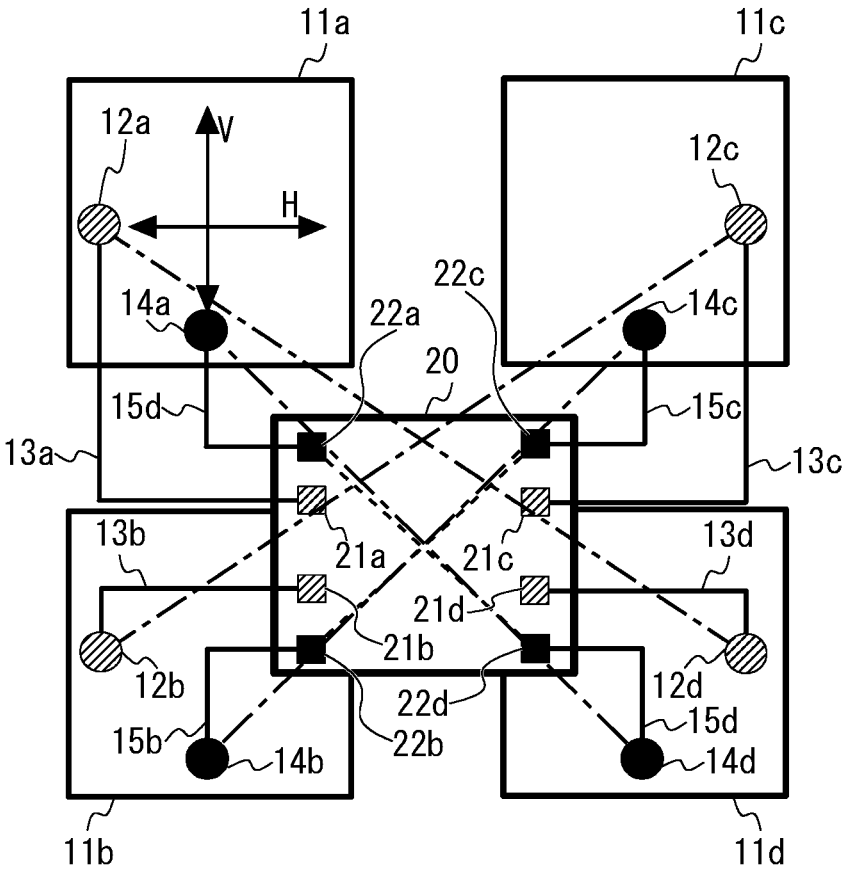
FIG. 8 is a diagram showing the configuration of the antenna according to the comparative example.

FIG. 8 shows a comparative example in which polarized shared antenna elements 11*a* to 11*d*, each of which is a polarized shared antenna element in which one antenna element generates two orthogonal polarized waves, are disposed in a 2×2 array. In the example of FIG. 8, the polarized wave directions of the antenna elements 11*a* to 11*d* are parallel to the direction in which the array is arranged. That is, the H polarized wave direction is parallel to the direction in which the antenna elements 11*a* and 11*c* are arranged, and the V polarized wave direction is parallel to the direction in which the antenna elements 11*a* and 11*b* are arranged.

Two transmission and reception units integrated in the integrated circuit 20 are respectively connected to two feeding point disposed at positions different from each other in one antenna element, in order to generate two types of polarized waves simultaneously in each of the antenna elements 11*a* to 11*d*. For example, in the one antenna element 11*a*, the two transmission and reception units 21*a* and 22*a* are respectively connected to the two feeding points 12*a* and 14*a* disposed at positions different from each other.

In order to make the characteristics of the two polarized waves of each antenna element equal when the above-described polarized wave shared antenna elements in which one antenna element generates two orthogonal polarized waves are arranged in an array, it is desired that all wirings to respective feeding points be made equal in length.

Figure 9:
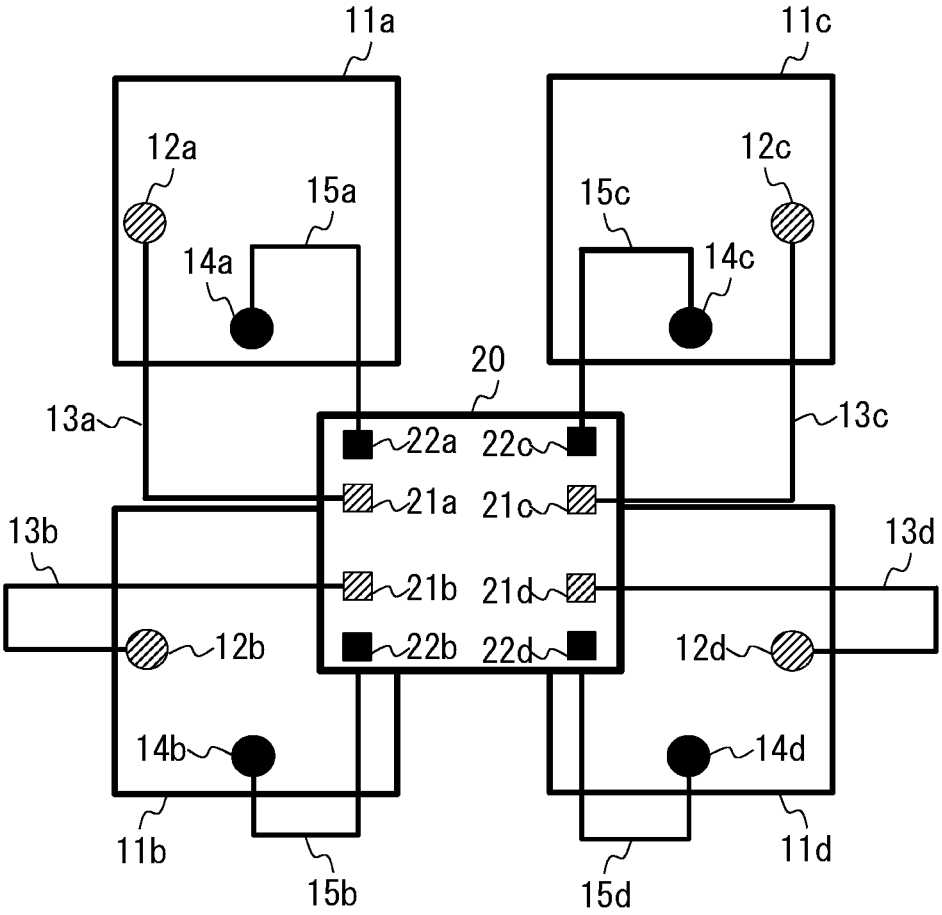
FIG. 9 is a diagram showing the configuration of the antenna according to the comparative example.

However, as shown in FIG. 8, the center position of the feeding points 12*a* to 12*d* of the two polarized waves, the center position of the feeding points 14*a* to 14*d* of the two polarized waves, and the center point of the four transmission and reception units 21*a* to 21*d* cannot be matched with each other, and thus all the wirings 13*a* to 13*d* and 15*a* to 15*d* that connect the feeding points to the transmission and reception units, respectively, cannot be made equal in length. In order to make all wirings to respective feeding points equal in length, wirings of complicated shapes as shown in FIG. 9 are required, which causes a problem that wiring loss increases and a man-hour for designing increases.

Figure 1:
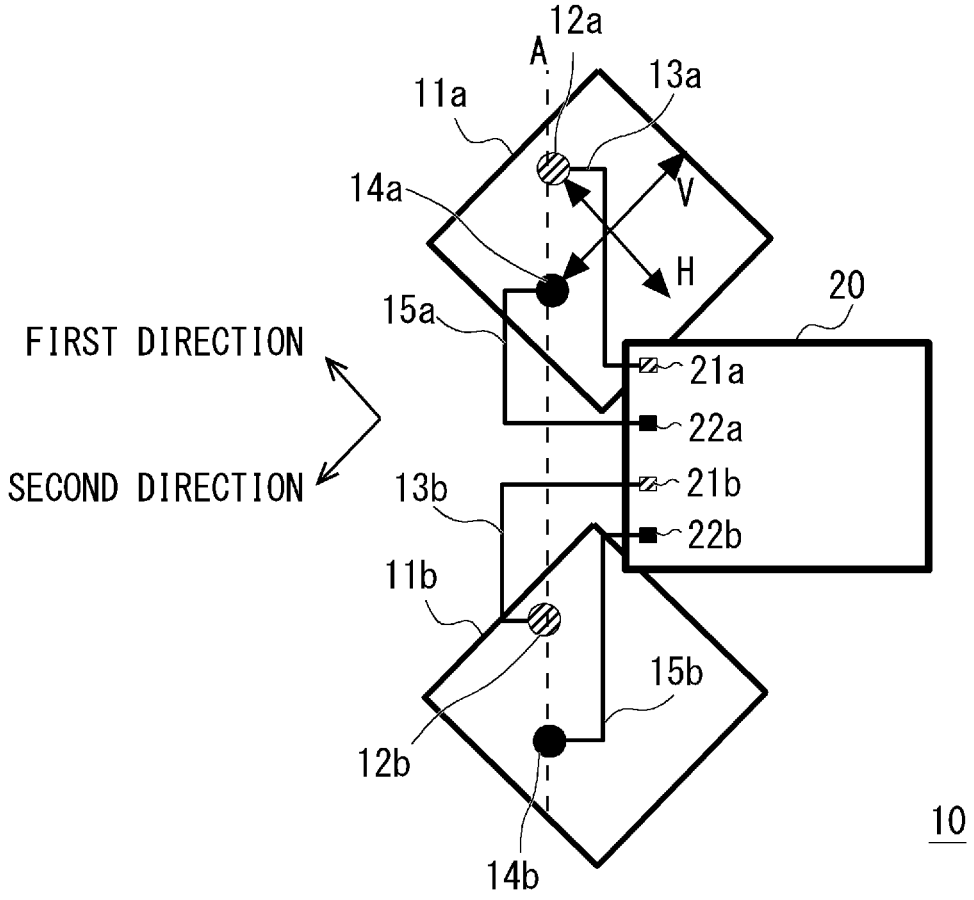
FIG. 1 is a diagram showing a configuration of a polarized wave shared array antenna according to an example embodiment.

To address the above problem, the inventors have conceived the polarized wave shared array antenna described below. FIG. 1 is a diagram showing the configuration of a polarized wave shared array antenna 10 according to the example embodiment. As shown in FIG. 1, the polarized wave shared array antenna 10 according to the example embodiment includes the antenna elements 11*a* and 11*b* provided adjacent to each other on one surface of the antenna substrate, each of which generates two orthogonal linear polarized waves. In the antenna element 11*a*, when viewed from a center of the antenna element 11*a*, the feeding point 12*a* is disposed in a first direction and the feeding point 14*a* is disposed in a second direction orthogonal to the first direction.

Further, in the antenna element 11*b*, when viewed from a center of the antenna element 11*b*, the feeding point 12*b* is disposed in the first direction and the feeding point 14*b* is disposed in the second direction. The integrated circuit 20 is provided on the other surface of the antenna substrate, and the transmission and reception units 21*a*, 22*a*, 21*b*, and 22*b* are formed on the integrated circuit 20 and are respectively connected to the feeding points 12*a*, 14*a*, 12*b*, and 14*b*. Further, the wirings 13*a*, 15*a*, 13*b*, and 15*b* that connect the feeding points 12*a*, 14*a*, 12*b*, and 14*b* to the transmission and reception units 21*a*, 22*a*, 21*b*, and 22*b*, respectively, are provided.

In a plan view, the feeding points 12*a*, 14*a*, 12*b*, and 14*b* are disposed so as to be arranged on a straight line, and the wirings 13*a*, 15*a*, 13*b*, and 15*b* are equal in length. This configuration enables wirings from a plurality of transmission and reception units integrated in an integrated circuit to respective feeding points of polarized wave shared antenna elements to be made equal in length without making the shapes of the wirings complicated. Specific example embodiment will be described below.

First Example Embodiment

Figure 2:
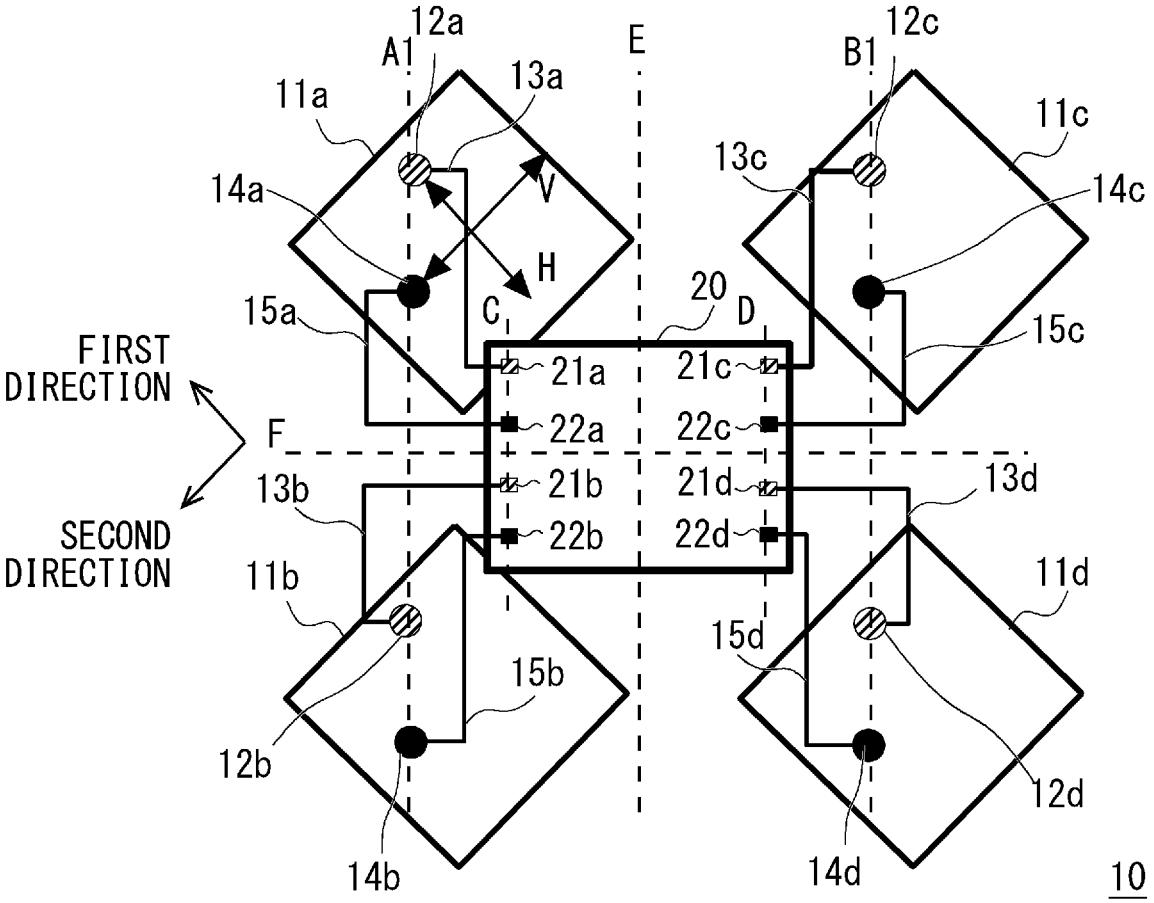
FIG. 2 is a diagram showing an example of a configuration of the polarized wave shared array antenna according to a first example embodiment.

FIG. 2 is a diagram showing an example of the configuration of a polarized wave shared array antenna according to a first example embodiment. The polarized wave shared array antenna 10 according to the first example embodiment includes the antenna elements 11*a* to 11*d* and the integrated circuit 20. Each of the antenna elements 11*a* to 11*d* is a polarized wave shared antenna element in which one antenna element generates two orthogonal polarized waves. The antenna elements 11*a* to 11*d* are arranged in a 2×2 array on one surface of the antenna substrate 1 as shown in FIG. 6.

Further, the integrated circuit 20 is mounted on the other surface of the antenna substrate 1. FIG. 2 is a plan view of a part of the configuration of the polarized wave shared array antenna 10 when viewed from the side of the polarized wave shared array antenna 10 on which the integrated circuit 20 is formed. In FIG. 2, in order to explain the positional relation between the antenna elements 11*a* to 11*d* and the integrated circuit 20, the antenna substrate 1 is made invisible and thus the entirety of the antenna elements 11*a* to 11*d* and the integrated circuit 20 can be seen.

Each antenna is a patch antenna, and is a microstrip antenna including a radiation conductor, a ground conductor, and a dielectric layer interposed between the radiation conductor and the ground conductor. The antenna elements 11*a* to 11*d* are radiation conductors that radiate radio waves and are formed on one surface of the antenna substrate 1 by a conductive layer. Note that a ground conductor is provided on the other surface of the antenna substrate 1 although it is not shown in the figure. The ground conductor functions as a ground of the microstrip antenna and is formed by a conductive layer.

As shown in FIG. 2, each of the antenna elements 11*a* to 11*d* has a square shape. As described above, in each of the antenna elements 11*a* to 11*d*, two feeding points are formed and disposed at positions different from each other. In each of the antenna elements, the two feeding points, respectively, are formed at the central parts of two adjacent sides. For example, in the antenna element 11*a*, the feeding points 12*a* and 14*a*, respectively, are formed at the central parts of two adjacent sides. The feeding points 12*b* to 12*d* and the feeding points 14*b* to 14*d* of the antenna elements 11*b* to 11*d* are disposed in a manner similar to that of the antenna element 11*a*.

The polarized wave direction of each of the antenna elements 11*a* to 11*d* is a direction shifted by 45° from the direction in which the array is arranged. That is, the H polarized wave direction is inclined by 45° from the direction in which the antenna elements 11*a* and 11*c* are arranged, and the V polarized wave direction is inclined by 45° from the direction in which the antenna elements 11*a* and 11*b* are arranged. That is, the antenna elements 11*a* to 11*d* shown in FIG. 2 are disposed by rotating each of the antenna elements 11*a* to 11*d* shown in FIG. 8 clockwise by 45°.

When viewed from the center of each of the antenna elements 11*a* to 11*d*, the feeding points 12*a* to 12*d* are disposed in the first direction, and the feeding points 14*a* to 14*d* are disposed in the second direction orthogonal to the first direction. In this example, the first direction is the H polarized wave direction, and the second direction is the V polarized wave direction orthogonal to the H polarization.

By this configuration, the feeding points 12*a*, 14*a*, 12*b*, and 14*b* are disposed so as to be arranged on a straight line A1 parallel to the direction in which the antenna elements 11*a* and 11*b* are arranged. Further, the feeding points 12*c*, 14*c*, 12*d*, and 14*d* are disposed so as to be arranged on a straight line B1 that is parallel to the direction in which the antenna elements 11*a* and 11*b* are arranged and is different from the straight line A1.

The transmission and reception units 21*a* to 21*d* and the transmission and reception units 22*a* to 22*d* are disposed in the integrated circuit 20. The integrated circuit 20 has a rectangular shape and is disposed so that left and right sides thereof are parallel to the straight lines A1 and B1.

The transmission and reception units 21*a*, 22*a*, 21*b*, and 22*b* are formed along the left side of the integrated circuit 20 in this order. The transmission and reception units 21*a*, 22*a*, 21*b*, and 22*b* are disposed so as to be arranged on a straight line C parallel to the straight line A1. The transmission and reception units 21*a*, 22*a*, 21*b*, and 22*b* are connected to the feeding points 12*a*, 14*a*, 12*b*, and 14*b* via the wirings 13*a*, 15*a*, 13*b*, and 15*b*, respectively.

Further, the transmission and reception units 21*c*, 22*c*, 21*d*, and 22*d* are formed along the right side of the integrated circuit 20 in this order. The transmission and reception units 21*c*, 22*c*, 21*d*, and 22*d* are disposed so as to be arranged on a straight line D parallel to the straight line A1. The transmission and reception units 21*c*, 22*c*, 21*d*, and 22*d* are connected to the feeding points 12*c*, 14*c*, 12*d*, and 14*d* via the wirings 13*c*, 15*c*, 13*d*, and 15*d*, respectively. These wirings 13*a* to 13*d* and 15*a* to 15*d* are all equal in length.

The wirings 13*a*, 15*a*, 13*b*, and 15*b*, respectively, have shapes symmetrical to the wirings 13*c*, 15*c*, 13*d*, and 15*d* with respect to a center line E that passes through the center of the straight lines C and D and is parallel the straight lines C and D. The point at which the line connecting the transmission and reception unit 21*a* to the transmission and reception unit 21*d* intersects the line connecting the transmission and reception unit 21*b* to the transmission and reception unit 21*c* and the point at which the line connecting the transmission and reception unit 22*a* to the transmission and reception unit 22*d* intersects the line connecting the transmission and reception unit 22*b* to the transmission and reception unit 22*c* are disposed on the center line E.

Further, in the first example embodiment, as the number of arrays in the vertical direction is two, which is an even number, the wirings 13*a*, 15*a*, 13*c*, and 15*c*, respectively, have shapes symmetrical to the wirings 13*b*, 15*b*, 13*d*, and 15*d* with respect to a straight line F that passes through the center of the transmission and reception units 22*a* and 21*b* and is orthogonal to the straight line C. Accordingly, the wirings 13*a*, 13*c*, 15*b*, and 15*d* have the same shape, and the wirings 15*a*, 15*c*, 13*b*, and 13*d* have the same shape. As described above, it is possible to make all the wirings equal in length without making the shapes of the wirings complicated with the wirings having two types of shapes. Thus, it is possible to make the characteristics of the two polarized waves of each of the antenna elements 11*a* to 11*d* equal.

Second Example Embodiment

Figure 3:
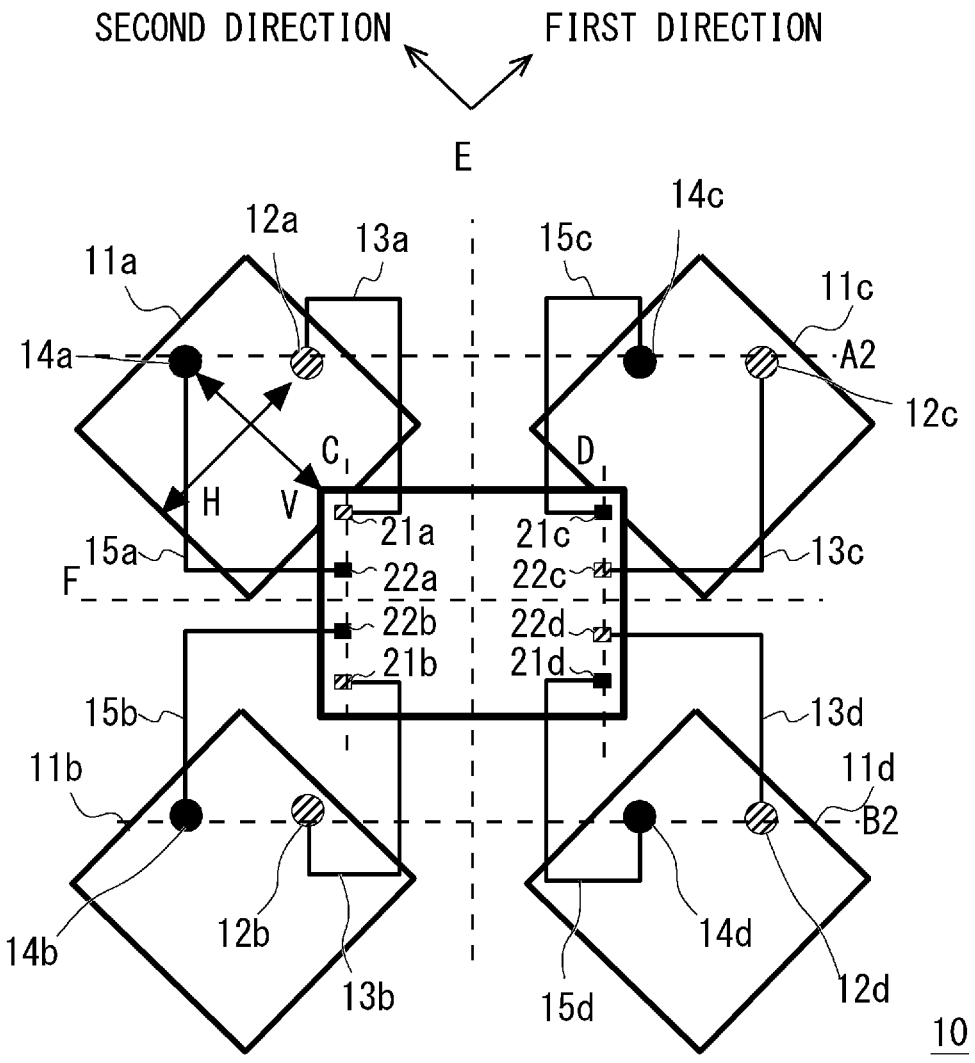
FIG. 3 is a diagram showing an example of a configuration of the polarized wave shared array antenna according to a second example embodiment.

FIG. 3 is a diagram showing an example of a configuration of the polarized wave shared array antenna according to a second example embodiment. In the second example embodiment, the polarized wave direction of each of the antenna elements 11*a* to 11*d* is a direction shifted by 45° from the direction in which the array is arranged. The antenna elements 11*a* to 11*d* shown in FIG. 3 are disposed by rotating each of the antenna elements 11*a* to 11*d* shown in FIG. 8 clockwise by 135°.

When viewed from the center of each of the antenna elements 11*a* to 11*d*, the feeding points 12*a* to 12*d* are disposed in the first direction, and the feeding points 14*a* to 14*d* are disposed in the second direction orthogonal to the first direction. By this configuration, the feeding points 12*a*, 14*a*, 12*c*, and 14*c* are disposed so as to be arranged on a straight line A2 parallel to the direction in which the antenna elements 11*a* and 11*c* are arranged. Further, the feeding points 12*b*, 14*b*, 12*d*, and 14*d* are disposed so as to be arranged on a straight line B2 that is parallel to the direction in which the antenna elements 11*b* and 11*d* are arranged and is different from the straight line A1.

If the feeding points will be connected to the transmission and reception units shown in FIG. 2 with the shortest wiring in the above arrangement of the feeding points, the wirings are caused to intersect each other. Although it is possible to intersect the wirings to each other by making the substrate a multilayer structure, signal loss increases at high frequencies and thereby affects transmission power and noise characteristics of the receiver. Therefore, as shown in FIG. 3, in the second example embodiment, the transmission and reception units 21*a*, 22*a*, 22*b*, and 21*b* are disposed on the straight line C orthogonal to the straight line A2 in this order. Further, the transmission and reception units 21*c*, 22*c*, 22*d*, and 21*d* are disposed on the straight line D orthogonal to the straight line A2 in this order. Thus, the feeding points can be connected to the transmission and reception units without the wirings intersecting each other.

The wirings 13*a*, 15*a*, 13*b*, and 15*b*, respectively, have shapes symmetrical to the wirings, 15*c*, 13*c*, 15*d*, and 13*d* with respect to the center line E that passes through the center of the straight lines C and D and is orthogonal to the straight line A2. Further, in the second example embodiment, as the number of arrays in the vertical direction is two, which is an even number, the wirings 13*a*, 15*a*, 13*c*, and 15*c*, respectively, have shapes symmetrical to the wirings 13*b*, 15*b*, 13*d*, and 15*d* with respect to the straight line F that passes through the center of the transmission and reception units 22*a* and 22*b* and is orthogonal to the straight line C. Accordingly, the wirings 13*a*, 13*b*, 15*c*, and 15*d* have the same shape, and the wirings 15*a*, 15*b*, 13*c*, and 13*d* have the same shape.

As described above, in the example embodiments, it is possible to easily make the characteristics of the wirings connecting the antenna elements to the transmission and reception units equal between the arrays and make the characteristics of the two polarized waves equal. The example embodiments are used for radio communication devices and are effective particularly in the case of a phased array antenna.

Figure 4:
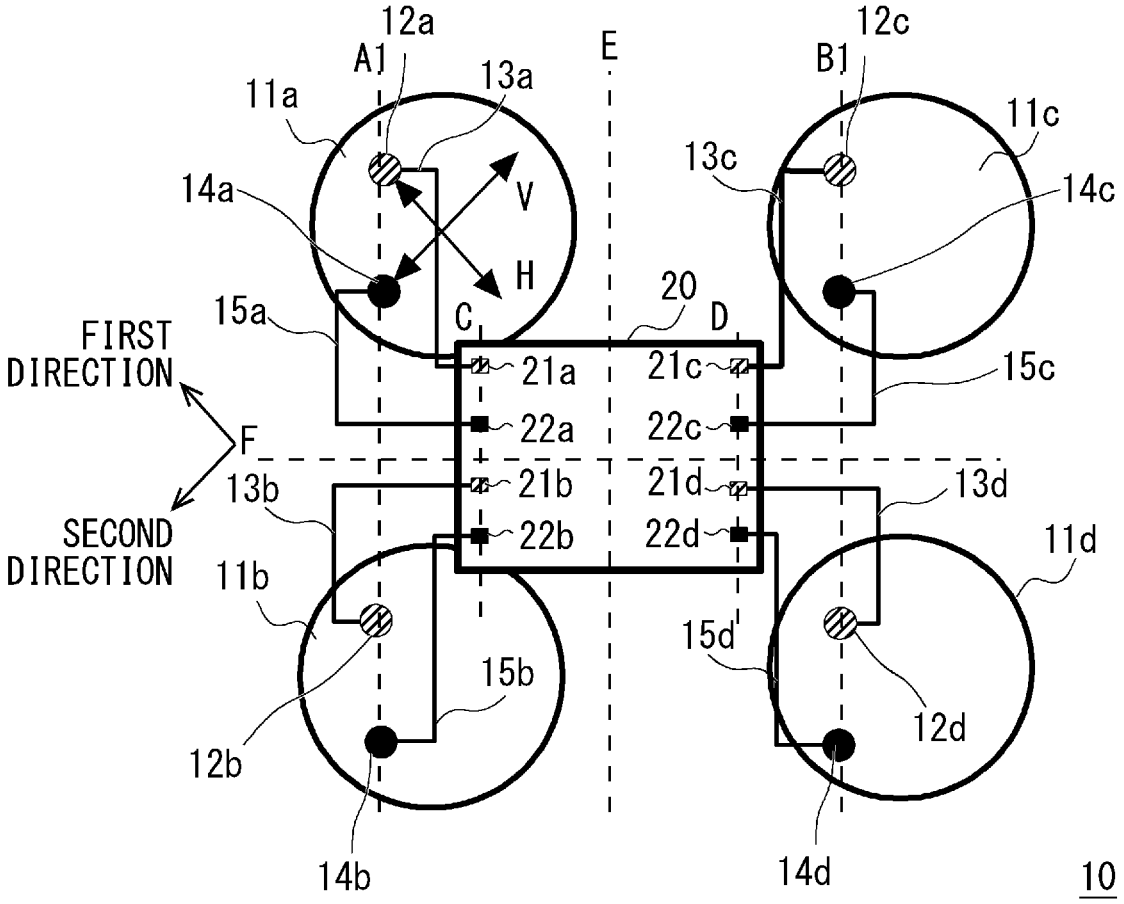
FIG. 4 is a diagram showing another example of a configuration of the polarized wave shared array antenna according to the example embodiments.

Note that the present disclosure is not limited to the aforementioned example embodiments and may be changed as appropriate without departing from the spirit of the present disclosure. In the aforementioned examples, although a square antenna element is used, a circular antenna element or the like as shown in FIG. 4 may be used. Further, although the wiring in the above examples is formed by a straight line bent at a right angle, it is not limited to this form. For example, the wiring may be formed by a straight line bent at an angle other than a right angle or may be formed by a curved line.

The first and second example embodiments can be combined as desirable by one of ordinary skill in the art.

While the disclosure has been particularly shown and described with reference to example embodiments thereof, the disclosure is not limited to these example embodiments. It will be understood by those of ordinary skill in the art that various changes in form and details may be made therein without departing from the spirit and scope of the present disclosure as defined by the claims.

What is claimed is:

1. A polarized wave shared array antenna, comprising:

a first antenna element and a second antenna element provided adjacent to each other on one surface of an antenna substrate, each of the first and the second antenna elements being configured to generate two orthogonal linear polarized waves;

a first feeding point disposed in the first antenna element in a first direction when viewed from a center of the first antenna element, and a second feeding point disposed in the first antenna element in a second direction orthogonal to the first direction when viewed from the center of the first antenna element;

a third feeding point disposed in the second antenna element in the first direction when viewed from a center of the second antenna element, and a fourth feeding point disposed in the second antenna element in the second direction when viewed from the center of the second antenna element;

an integrated circuit provided on another surface of the antenna substrate;

a first transmission and reception unit, a second transmission and reception unit, a third transmission and reception unit and a fourth transmission and reception unit that are provided on the integrated circuit and are respectively connected to the first to the fourth feeding points; and a first wiring, a second wiring, a third wiring, and a fourth wiring that connect the first to the fourth feeding points to the first to the fourth transmission and reception units, respectively, wherein in a plan view, the first, the second, the third, and the fourth feeding points are disposed so as to be arranged on a first straight line, and the first to the fourth wirings are equal in length.

2. The polarized wave shared array antenna according to claim 1, wherein the first to the fourth transmission and reception units are disposed so as to be arranged on a second straight line parallel to the first straight line.

3. The polarized wave shared array antenna according to claim 2, wherein the first to the fourth transmission and reception units are arranged on the second straight line in order, and with respect to a third straight line that passes through a center of the second and the third transmission and reception units and is orthogonal to the second straight line, the first wiring and the fourth wiring are symmetric and the second and the third wirings are symmetric.

4. The polarized wave shared array antenna according to claim 3, further comprising:

a third antenna element adjacent to the first antenna element and a fourth antenna element adjacent to the second antenna element, the third and the fourth antenna elements being disposed in a 2×2 array with the first and the second antenna elements;

a fifth feeding point disposed in the third antenna element in the first direction when viewed from a center of the third antenna element, and a sixth feeding point disposed in the third antenna element in the second direction when viewed from the center of the third antenna element;

a seventh feeding point disposed in the fourth antenna element in the first direction when viewed from a center of the fourth antenna element, and an eighth feeding point disposed in the fourth antenna element in the second direction when viewed from the center of the fourth antenna element; and a fifth transmission and reception unit, a sixth transmission and reception unit, a seventh transmission and reception unit, and an eighth transmission and reception unit that are provided on the integrated circuit and are respectively connected to the fifth to the eighth feeding points, wherein the fifth to the eighth transmission and reception units are disposed so as to be arranged on a fourth straight line that is parallel to the first straight line and is different from the second straight line, and a fifth wiring, a sixth wiring, a seventh wiring and an eighth wiring connecting the fifth to the eighth feeding points to the fifth to the eighth transmission and reception units, respectively, are symmetrical to the first to fourth wirings, respectively, with respect to a center line that passes through a center of the second and the third straight lines and is parallel to the second and the third straight lines.

5. The polarized wave shared array antenna according to claim 1, wherein the first and the second transmission and reception units are provided so as to be arranged on a second straight line orthogonal to the first straight line, and the third and the fourth transmission and reception units are provided so as to be arranged on a third straight line that is orthogonal to the first straight line and is different from the second straight line.

6. The polarized wave shared array antenna according to claim 5, wherein with respect to a center line that passes through a center of the second and the third straight lines and is orthogonal to the first straight line, the first wiring is symmetric to the fourth wiring, and the second wiring is symmetric to the third wiring.

7. The polarized wave shared array antenna according to claim 4, further comprising:

the third antenna element adjacent to the first antenna element and the fourth antenna element adjacent to the second antenna element, the third and the fourth antenna elements being disposed in a 2×2 array with the first and the second antenna elements;

the fifth feeding point disposed in the third antenna element in the first direction when viewed from a center of the third antenna element, and the sixth feeding point disposed in the third antenna element in the second direction when viewed from the center of the third antenna element;

the seventh feeding point disposed in the fourth antenna element in the first direction when viewed from a center of the fourth antenna element, and the eighth feeding point disposed in the fourth antenna element in the second direction when viewed from the center of the fourth antenna element;

the fifth transmission and reception unit to the eighth transmission and reception unit that are provided on the integrated circuit and are respectively connected to the fifth to the eighth feeding points; and the fifth to the eighth wirings connecting the fifth to the eighth feeding points to the fifth to the eighth transmission and reception units, respectively, wherein the fifth and the sixth transmission and reception units are disposed so as to be arranged on the second straight line, the seventh and the eighth transmission and reception units are disposed so as to be arranged on the third straight line, the first, the second, the sixth, and the fifth transmission and reception units are arranged on the second straight line in order, and with respect to a fourth straight line that passes through a center of the second and the sixth transmission and reception units and is orthogonal to the second straight line, the fifth to the eighth wirings, respectively, are symmetric to the first to the fourth wirings.

8. The polarized wave shared array antenna according to claim 1, wherein each of the first and the second antenna elements has a square shape, the first and the second feeding points, respectively, are formed at central parts of two adjacent sides of the first antenna element, and the third and the fourth feeding points, respectively, are formed at central parts of two adjacent sides of the second antenna element.

9. The polarized wave shared array antenna according to claim 1, wherein each of the first and the second antenna elements has a circular shape.

10. A method for manufacturing a polarized wave shared array antenna, the method comprising:

providing a first antenna element and a second antenna element so as to be adjacent to each other on one surface of an antenna substrate, each of the first and the second antenna elements being configured to generate two orthogonal linear polarized waves;

disposing a first feeding point in the first antenna element in a first direction when viewed from a center of the first antenna element and a second feeding point in the first antenna element in a second direction orthogonal to the first direction when viewed from the center of the first antenna element;

disposing a third feeding point in the second antenna element in the first direction when viewed from a center of the second antenna element and a fourth feeding point in the second antenna element in the second direction orthogonal to the first direction when viewed from the center of the second antenna element;

providing an integrated circuit on another surface of the antenna substrate;

providing a first transmission and reception unit, a second transmission and reception unit, a third transmission and reception unit and a fourth transmission and reception unit on the integrated circuit, the first to the fourth transmission and reception units, respectively, being connected to the first to the fourth feeding points;

disposing the first, the second, the third, and the fourth feeding points so as to be arranged on a first straight line in a plan view; and forming a first wiring, a second wiring, a third wiring and a fourth wiring that connect the first to the fourth feeding points to the first to the fourth transmission and reception units, respectively, the first to the fourth wirings being equal in length.

* * * * *